US009138998B2

(12) United States Patent
Ohnishi et al.

(10) Patent No.: US 9,138,998 B2
(45) Date of Patent: Sep. 22, 2015

(54) LIQUID DROP EJECTING HEAD, IMAGE FORMING DEVICE, AND METHOD OF MANUFACTURING LIQUID DROP EJECTING HEAD

(71) Applicants: Kouji Ohnishi, Hyogo (JP); Kohzoh Urasaki, Hyogo (JP); Manabu Nishimura, Kanagawa (JP)

(72) Inventors: Kouji Ohnishi, Hyogo (JP); Kohzoh Urasaki, Hyogo (JP); Manabu Nishimura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 13/847,650

(22) Filed: Mar. 20, 2013

(65) Prior Publication Data

US 2013/0250008 A1 Sep. 26, 2013

(30) Foreign Application Priority Data

Mar. 22, 2012 (JP) ..... 2012-064862

(51) Int. Cl.

| | |
|---|---|
| ***B41J 2/135*** | (2006.01) |
| ***B41J 2/17*** | (2006.01) |
| ***B41J 2/14*** | (2006.01) |
| ***B41J 2/16*** | (2006.01) |

(52) U.S. Cl.

CPC ..... *B41J 2/14233* (2013.01); *B41J 2/161* (2013.01); *B41J 2/1606* (2013.01); *B41J 2/1623* (2013.01); *B41J 2/1625* (2013.01); *B41J 2/1628* (2013.01); *B41J 2/1631* (2013.01); *B41J 2/1642* (2013.01); *B41J 2/1646* (2013.01); *B41J 2002/14241* (2013.01)

(58) Field of Classification Search

None

See application file for complete search history.

(56) References Cited

U.S. PATENT DOCUMENTS

| | | | | |
|---|---|---|---|---|
| 2005/0046671 | A1* | 3/2005 | Cabal et al. | 347/54 |
| 2007/0019033 | A1* | 1/2007 | Sim et al. | 347/47 |
| 2010/0245475 | A1* | 9/2010 | Masashi et al. | 347/45 |
| 2011/0163451 | A1* | 7/2011 | Matsumoto et al. | 257/751 |

FOREIGN PATENT DOCUMENTS

| | | | |
|---|---|---|---|
| JP | 2002-160361 | | 6/2002 |
| JP | 2008-105334 | | 5/2008 |
| JP | 2008105334 A | * | 5/2008 |

* cited by examiner

*Primary Examiner* — Erica Lin

(74) *Attorney, Agent, or Firm* — Cooper & Dunham LLP

(57) ABSTRACT

A liquid drop ejecting head includes a a nozzle plate to form nozzles, a liquid chamber substrate including one surface bonded to the nozzle plate and forming liquid chambers provided for the nozzles and communicating with the nozzles, a diaphragm bonded to the other surface of the liquid chamber substrate to form a part of each liquid chamber, and a pressure generating unit giving pressure oscillation to the diaphragm in accordance with a liquid drop eject signal to exert pressure on a liquid in each liquid chamber through the diaphragm. In the liquid drop ejecting head, a protection film is formed on an inner side wall of each liquid chamber by a chemical reaction of fluorocarbon and silicon fluoride oxide of a by-product formed on the inner side wall of the liquid chamber with the formation of the liquid chambers in the liquid chamber substrate.

2 Claims, 9 Drawing Sheets

LIQUID DROP EJECTING HEAD, IMAGE FORMING DEVICE, AND METHOD OF MANUFACTURING LIQUID DROP EJECTING HEAD

BACKGROUND OF THE INVENTION

1. Field of the Invention

The present disclosure relates to a liquid drop ejecting head which ejects liquid drops from nozzles, an image forming device including the liquid drop ejecting head to form an image on a print medium by ejecting liquid drops, and a method of manufacturing the liquid drop ejecting head.

2. Description of the Related Art

A liquid drop ejecting head which ejects liquid drops from nozzles is used, for example, as a printing head in image forming devices, such as copiers, printers, facsimile devices, plotters, and multi-function peripherals. The image forming device is a device which forms an image on a print medium by ejecting liquid drops to the print medium. In the following, the material of the print medium is not limited to paper, and the print medium used in the image forming devices of the liquid drop ejection type may include all printing sheets (paper), yarn, fibers, textile, leather, metal, plastics, glass, wood, and ceramics. The image formation performed by the image forming devices of the liquid drop ejection type may include image formation of meaningful images, such as characters or figures, and image formation of meaningless images, such as patterns, (in which liquid drop ejection is formed). The liquid used in the image forming devices of the liquid drop ejection type is not limited to ink and may include printing liquid (ink), fixing process solutions, DNA samples, resist materials, pattern materials, resins, etc.

Conventionally, there is known a liquid drop ejecting head which is commonly used in the image forming devices described above. This liquid drop ejecting head generally includes a nozzle plate, a channel plate, a diaphragm, and a pressure generating unit. The nozzle plate forms one or plural nozzles provided therein. The channel plate is a plate member which forms a common liquid chamber and individual liquid chambers. The individual liquid chambers are provided corresponding to the nozzles respectively and communicate with the nozzles. The common liquid chamber communicates with the individual liquid chambers and supplies liquid to the individual liquid chambers. The diaphragm is a component which forms a part of the individual liquid chambers and transmits pressure oscillation given by deformations of the pressure generating unit to the liquid in the individual liquid chambers. The diaphragm is deformed by the pressure generating unit in accordance with a liquid drop eject signal received from the host device, and the pressure oscillation from the pressure generating unit is transmitted to the liquid in the individual liquid chambers through the diaphragm. For example, a piezoelectric actuator is used as the pressure generating unit.

In this liquid drop ejecting head, the pressure oscillation by the pressure generating unit is given to the diaphragm in accordance with the liquid drop eject signal from the host device. The deformations of the diaphragm due to the pressure oscillation are transmitted to the liquid in the individual liquid chambers to exert pressure on the liquid and eject liquid drops from the nozzles of the nozzle plate to a print medium.

In recent years, various kinds of ink are used in an ink jet printing head which is a typical example of the liquid drop ejecting head. Especially, when an alkaline ink is used and a liquid chamber substrate to form an ink jet printing head is made of a silicon material, there is a problem that inner side walls of a liquid chamber formed in the liquid chamber substrate are easily eroded by the alkaline ink.

Japanese Laid-Open Patent Publication No. 2008-105334 discloses a liquid drop ejecting head in which a protection film is formed to cover the inner side walls of the liquid chamber, in order to prevent the corrosion of the inner side walls by alkaline inks. In a case of the liquid drop ejecting head of Japanese Laid-Open Patent Publication No. 2008-105334, a liquid chamber is formed in a liquid chamber substrate by etching, and by using a plasma polymerization method, a film of an oxide of silicon dioxide is deposited as a protection film on the inner side walls of the liquid chamber that may contact an alkaline liquid material. By using the plasma polymerized film, good liquid resistance to the alkaline liquid is obtained. In the following, a film which is formed by using the plasma polymerization method is called plasma polymerized film.

However, in the liquid drop ejecting head of Japanese Laid-Open Patent Publication No. 2008-105334, after etching of the liquid chamber substrate to form the liquid chamber is performed, the plasma polymerized film is formed on the inner side walls of the liquid chamber using the plasma polymerization method. It has been difficult to form a uniform plasma polymerized film having a predetermined thickness on the inner side walls of the liquid chamber.

Specifically, the plasma polymerization method is a film deposition method in which a plasma polymerized film is formed by causing the ionized components of the plasma polymerized film between the mutually opposed electrodes to adhere to the film deposition object disposed between the electrodes. For this reason, in the liquid chamber formed by etching the liquid chamber substrate, the plasma polymerized film is uniformly formed on the surfaces facing the electrodes, but the ionized components of the plasma polymerized film cannot easily be caused to adhere to the surfaces parallel to the surfaces facing the electrodes. As a result, the thickness distribution of the plasma polymerized film formed is not uniform, and a thin portion in the thickness distribution which is less than a predetermined thickness is vulnerable to erosion. The liquid resistance of such a thin portion becomes excessively low.

In addition to the above-described plasma polymerization method, a thermal oxidation method is known as a film deposition method for forming an oxide film of silicon dioxide. In this thermal oxidation method, an oxide film is deposited at high temperature, and there has been a problem that the liquid chamber substrate which forms the liquid chamber is deformed by the heating.

SUMMARY OF THE INVENTION

In one aspect, the present disclosure provides a liquid drop ejecting head in which a protection film with a uniform thickness is formed on the inner side walls of the liquid chamber and has an excellent liquid resistance without affecting the liquid chamber substrate.

In an embodiment which solves or reduces one or more of the above-described problems, the present disclosure provides a liquid drop ejecting device including: a nozzle plate that forms nozzles; a liquid chamber substrate that includes a first surface bonded to the nozzle plate and forms liquid chambers provided for the nozzles and communicating with the nozzles respectively; a diaphragm that is bonded to a second surface of the liquid chamber substrate opposite to the surface to form a part of each of the liquid chambers; and a pressure generating unit that gives pressure oscillation to the diaphragm in accordance with a liquid drop eject signal from a host device to exert pressure on a liquid in each of the liquid chambers through the diaphragm, wherein a protection film is formed on an inner side wall of each of the liquid chambers by a chemical reaction of fluorocarbon and silicon fluoride oxide of a by-product formed on the inner side wall of each of the liquid chambers with the formation of the liquid chambers in the liquid chamber substrate.

Other objects, features and advantages of the present disclosure will become more apparent from the following detailed description when read in conjunction with the accompanying drawings.

DETAILED DESCRIPTION OF THE PREFERRED EMBODIMENTS

A description will be given of embodiments of the present disclosure with reference to the accompanying drawings.

Figure 1:
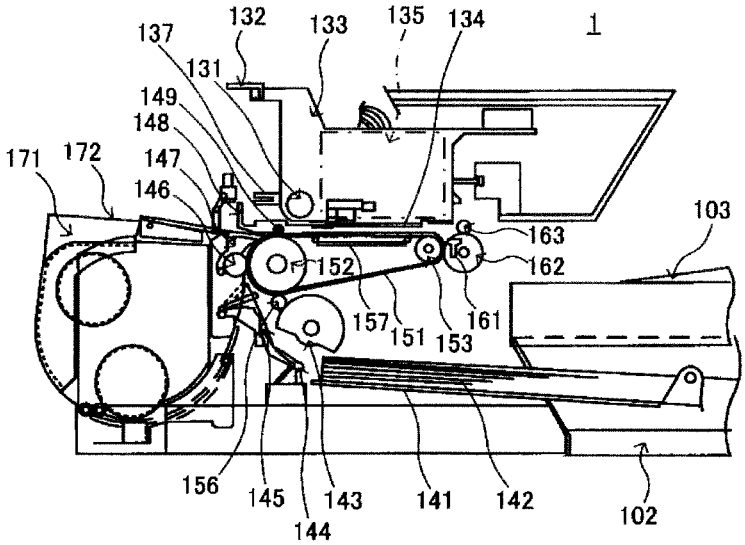
FIG. 1 is a side view of a mechanical part of an ink jet printer of an embodiment of the present disclosure.
Figure 2:
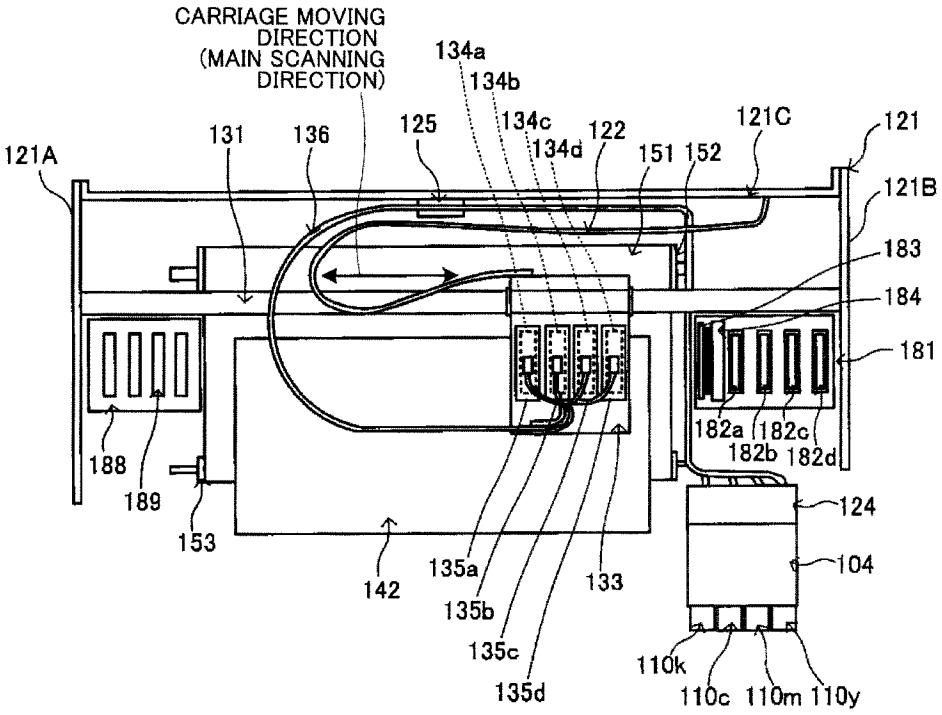
FIG. 2 is a plan view of the mechanical part of the ink jet printer.

First, the composition of a mechanical part of an ink jet printer 1 of an embodiment of the present disclosure will be described with reference to FIGS. 1 and 2. FIG. 1 is a side view of the mechanical part of the ink jet printer 1. FIG. 2 is a plan view of the mechanical part of the ink jet printer 1.

The mechanical part of the ink jet printer 1 includes left and right side plates 1211 and 121B to form a frame 121. In the mechanical part of ink jet printer 1, a guide rod 131 and a stay 132 are transversely extending guide members, and end portions of the guide members are secured to the side plates 121A and 121B. A carriage 133 is held on the guide rod 131 and the stay 132 to be movable in a main scanning direction. The carriage 133 is moved by a main scanning motor (which is not illustrated) through a timing belt in one of bidirectional main scanning directions (carriage moving directions) indicated by the arrow in FIG. 2.

On the carriage 133, a liquid drop ejecting head 134 including four liquid drop ejecting heads 134*a*-134*d* is mounted, and the liquid drop ejecting heads 134*a*-134*d* are arrayed to extend in a direction perpendicular to the main scanning directions. The liquid drop ejecting heads 134*a*-134*d* are provided to eject ink drops of respective colors of yellow (Y), cyan (C), magenta (M) and black (K) with the nozzle surface directed downward. Alternatively, the liquid drop ejecting head 134 may be a single liquid drop ejecting head including four nozzle members having nozzles for ejecting ink drops of the four colors, respectively.

The ink jet head which constitutes the liquid drop ejecting head 134 may employ as a pressure generating unit to generate a pressure for ejecting liquid drops any of a piezoelectric actuator using a piezoelectric element, a thermal actuator using a phase change due to liquid film boiling of an electric conversion element, such as a heating resistor, a shape memory alloy actuator using a metallic phase change due to temperature changes, and an electrostatic actuator using electrostatic force, etc.

On the carriage 133, head tanks 135*a*-135*d* are mounted for supplying the inks of the four colors to the liquid drop ejecting heads 134*a*-134*d*, respectively. The four-color inks from the ink cartridges 110*y*, 110*m*, 110*c* and 110*k* (which are arranged in a cartridge loading portion 104) are respectively supplied to the head tanks 135*a*-135*d* through a flexible ink supply tube 136. The used ink remaining in the carriage 133 is supplied to a used ink tank (not illustrated) through a flexible ink collecting tube 122. In the cartridge loading portion 104, a hydraulic pump unit 124 for supplying the ink from each ink cartridge 110 is arranged. An intermediate part of the ink supply tube 136 is held on a rear plate 121C (which constitutes a part of the frame 121) by a locking member 125. The pump unit 124 is capable of sending the ink in the reverse direction opposite to the ink supplying direction (ink reversing capability).

A semicircular feed roller 143 and a separator pad 144 are arranged as a sheet feeding means. This sheet feeding means picks up one of printing sheets 142 loaded on a sheet loading plate (pressure plate) 141 of a sheet feeding tray 102 shown in FIG. 1 and sends the printing sheet 142 to a sheet guiding means (which will be described below). The feed roller 143 and the separator pad 144 are faced to each other to perform separation of one sheet from the printing sheets 142 on the sheet loading plate 141 and feeding of the single printing sheet 142. The separator pad 144 is made of a friction material having a high friction coefficient and disposed to face the feed roller 143. The separator pad 144 is elastically pressed on the feed roller 143 side.

In order to transport the printing sheet 142 sent from the sheet feeding means to a location beneath the liquid drop ejecting head 134, a guide member 145, a counter roller 146, a conveyance guide member 147, and a retainer member 148 having a front-end pressurizing roller 149 are provided as the sheet guiding means to guide the transport of the printing sheet 142. Further, a transporting belt 151 is provided as a transporting means to electrostatically attract the printing sheet 142 sent from the sheet feeding means and transport the attracted printing sheet 142 in a vicinity of the location beneath the liquid drop ejecting head 134. The transporting belt 151 is an endless-type belt, and this transporting belt 151 is wound between a conveyance roller 152 and a tension roller 153 and arranged so that the transporting belt 151 is moved in a belt transporting direction (which is a sub-scanning direction perpendicular to the main scanning direction). A charging roller 156 is disposed to contact a surface of the transporting belt 151 as a charging means for electrostatically charging the surface of the transporting belt 151. This charging roller 156 is arranged so that the charging roller 156 follows the rotation of the transporting belt 151 and is rotatable. Further, a guide member 157 is disposed on a back surface of the transporting belt 151 at a position corresponding to a printing area by the liquid drop ejecting head 134.

The transporting belt 151 is moved in the belt transporting direction through the conveyance roller 152 which is rotated in a controlled timing by a sub-scanning motor (not illustrated).

As a sheet output means to output the printing sheet 142 on which an image is printed by the liquid drop ejecting head 134, a separator claw 161 for separating the printing sheet 142 from the transporting belt 151, a delivery roller 162, and a delivery roller 163 are provided. A sheet output tray 103 is disposed under the delivery roller 162.

Further, a duplex unit 171 is detachably attached to a rear portion of a main body of the ink jet printer 1. The duplex unit 171 receives the printing sheet 142 which is returned by the reverse rotation of the transporting belt 151, inverts the printing sheet 142, and sends the inverted printing sheet 142 again to the location between the counter roller 146 and the transporting belt 151. An upper surface of the duplex unit 171 is formed into a manual bypass tray 172.

As shown in FIG. 2, in a non-printing area on one side of the carriage 133 in the main scanning direction, a recovery device 181 is disposed. The recovery device 181 includes a recovery means to maintain and recover the state of the nozzles of the liquid drop ejecting head 134.

In this recovery device 181, cap members 182*a*-182*d* (which will be called caps 182 in a collective meaning) to perform capping of the respective nozzle surfaces of the liquid drop ejecting head 134, a wiper blade 183 (which is a blade member to perform wiping of the nozzle surfaces), and a draining ejection container 184 are provided. When performing draining ejection in which liquid drops which are not related to printing are ejected from the nozzles in order to eliminate the thickened printing liquid in the nozzles, the draining ejection container 184 receives the liquid drops. In the present embodiment, the cap 182*a* is used as a suction/moisturizing cap and the other caps 182*b*-182*d* are used as moisturizing caps.

In the ink jet printer 1, the waste ink produced in a maintenance and recovery operation by the recovery device 181, the ink received in the caps 182, the ink removed from the wiper blade 183 by a wiper cleaner (not illustrated), and the ink produced in a draining ejection and received in the draining ejection container 184 are collected and accommodated in a waste ink tank (which is not illustrated).

Further, as shown in FIG. 2, in a non-printing area on the other side of the carriage 133 in the main scanning direction, a draining ejection container 188 is disposed. When performing the draining ejection during a printing job in order to eliminate the thickened printing liquid in the nozzles, the draining ejection container 188 receives the liquid drops. In the draining ejection container 188, plural openings 189 are formed to face the nozzles in the nozzle surfaces of the liquid drop ejecting head 134.

In the ink jet printer of the present embodiment, one of the printing sheets 142 from the sheet feeding tray 102 is separated, and the printing sheet 142 is fed upward from the sheet feeding tray 102 and guided by the guide member 145. The printing sheet 142 is inserted between the transporting belt 151 and the counter roller 146 and transported, and the front end of the printing sheet 142 is guided by the conveyance guide 137 and pressed on the transporting belt 151 by the front-end pressurizing roller 149. The transporting direction of the printing sheet 142 is changed by about 90 degrees to the horizontal direction with the rotation of the transporting belt 151.

At this time, an AC voltage in which a positive charging voltage level and a negative charging voltage level are alternately present is supplied from an AC bias supplying part of a control unit (which will be described below) to the charging roller 156. The surface of the transporting belt 151 is electrostatically charged by the charging roller 156 to include a belt-like portion in which positively charged areas and negatively charged areas are alternately present at predetermined intervals in the sub-scanning direction.

When the printing sheet 142 is sent to the transporting belt 151, the printing sheet 142 is attracted by the transporting belt 151 and transported in the sub-scanning direction in accordance with the movement of the transporting belt 151.

When the carriage 133 is moved in the main scanning direction based on the scanning positional information output by a linear encoder 137, the liquid drop ejecting head 134 is driven in accordance with an image signal to eject the ink drops to the printing sheet 142 in a stopped condition, so that an image is printed on the printing sheet 142 by one line. Subsequently, after the printing sheet 142 is moved in the sub-scanning direction by a given transport amount, an image is printed on the printing sheet 142 by the following line. When a print end signal or a detection signal indicating arrival of a rear end of the printing sheet 142 at the printing area is received, the ink jet printer 1 terminates the printing operation and transports the printing sheet 142 to the sheet output tray 103.

When the ink jet printer 1 is in a standby state (before printing), the carriage 133 is moved to the recovery device 181 side, capping of the nozzles of the liquid drop ejecting head 134 is performed by the caps 182 of the recovery device 181, and insufficient ejection due to ink dryness is prevented by maintaining the nozzles in a wet condition. In addition, when capping of the liquid drop ejecting head 134 is performed by the caps 182, a recovery operation is performed in which the printing liquid is attracted from the nozzles by a suction pump (not illustrated) in order to eliminate the thickened printing liquid and air bubbles from the liquid drop ejecting head 134. Further, before a printing job is started or during a printing job, a draining ejection operation in which ink drops which are not related to printing are ejected from the liquid drop ejecting head 134 is performed, so that stable ejection performance of the liquid drop ejecting head 134 is maintained.

Figure 3:
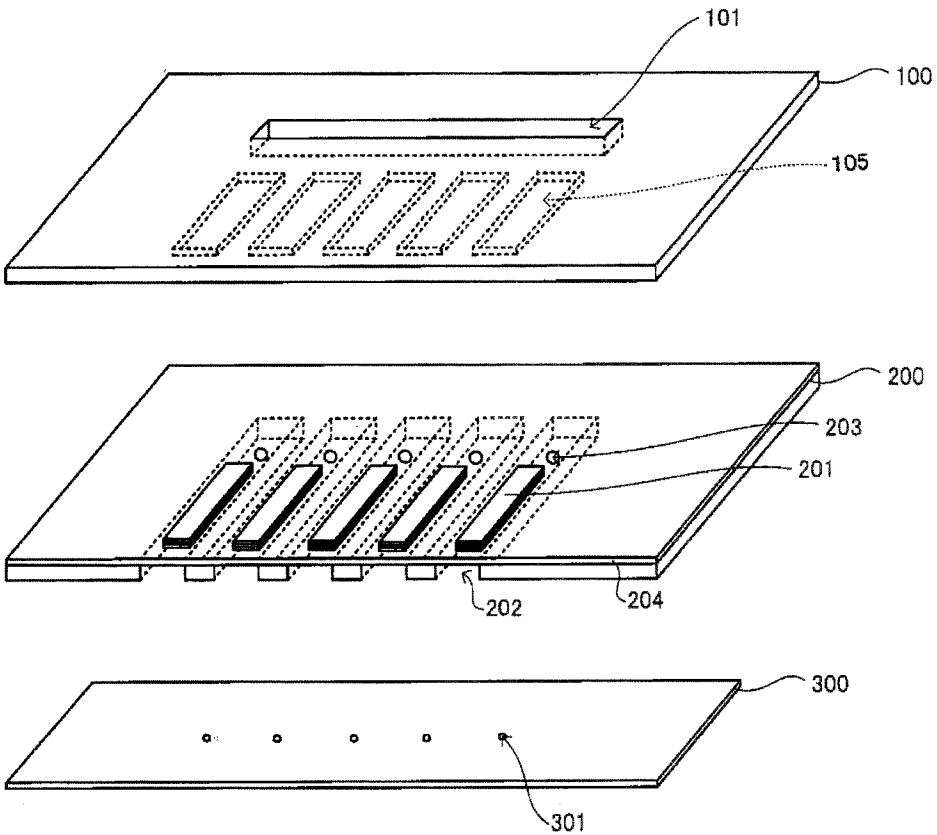
FIG. 3 is an exploded perspective view of an ink jet head of an embodiment of the present disclosure.
Figure 4:
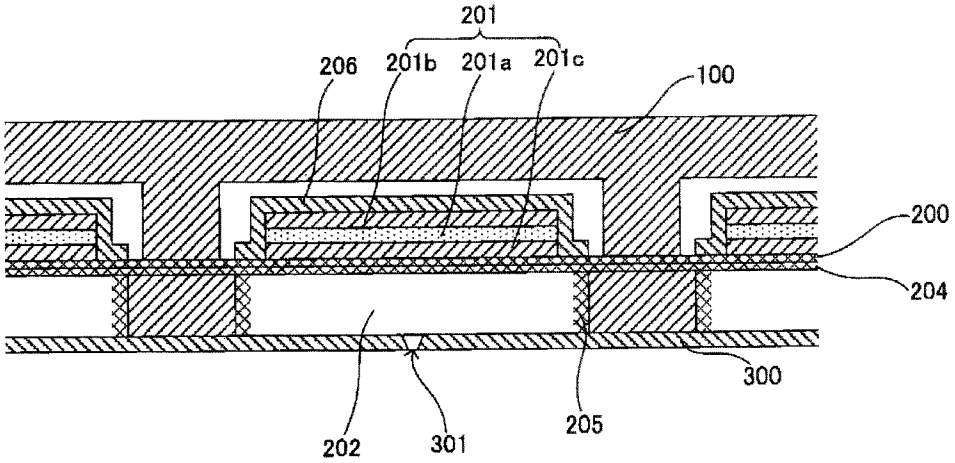
FIG. 4 is a cross-sectional view showing the composition of an actuator portion of the ink jet head.

Next, an ink jet head which is an embodiment of the liquid drop ejecting head of the present disclosure will be described. FIG. 3 is an exploded perspective view of the ink jet head of this embodiment. FIG. 4 is a cross-sectional view of an actuator portion in the ink jet head of this embodiment.

As shown in FIG. 3, the ink jet head of this embodiment generally includes a sub frame plate 100, an actuator plate 200 and a nozzle plate 300 which are bonded together by an adhesive.

The sub frame plate 100 is formed from a silicon substrate, and an ink supply opening 101 for supplying ink from the outside of the ink jet head and actuator protection cavities 105 are formed in the silicon substrate. In addition, in the sub frame plate 100, a mark for alignment with the actuator plate 200 and an opening for connection of electric wiring to the outside are formed.

The actuator plate 200 is formed from a silicon substrate. On one surface of the actuator plate 200, actuator elements 201 are formed and each actuator element 201 has a layered structure in which an upper electrode film 201*b*, a piezoelectric film 201*a*, and a lower electrode film 201*c* are laminated on top of each other. On each of the actuator elements 201, an insulating protection film 206, a metal wiring layer (not illustrated) for transmitting a signal to an external drive circuit, and a passivation protection film (not illustrated) for protecting the metal wiring layer are formed. On the opposite surfaces of the actuator elements 201, ink liquid chambers 202 are formed via a diaphragm 204. Ink from an external part (not illustrated) is supplied to each of the ink liquid chambers 202 through an ink supply hole 203 formed in a corresponding one of the ink liquid chambers 202.

The nozzle plate 300 is provided on the actuator plate 200, and the nozzle plate 300 and the actuator plate 200 are bonded together. Nozzles 301 which correspond to the ink liquid chambers 202 are formed in the nozzle plate 300. For example, as the nozzle plate 300, a nozzle plate made of a SUS (stainless steel) plate in which the nozzles 301 are formed by press forming, or a nozzle plate made of a nickel plate in which the nozzles 301 are formed by electroforming of Ni (nickel) may be used.

Operation of the actuator portion will be explained. When a drive signal (not illustrated) received from an external drive circuit is transmitted to each actuator element and the actuator element 201 is deformed, the diaphragm 204 is deformed to exert pressure on the ink in the ink liquid chamber 202 and eject ink drops from the nozzles 301.

Next, a liquid contact film which is a protection film formed on the inner side walls of the ink liquid chamber 202 will be described.

In the technology according to the related art, a liquid contact film is formed after the formation of the ink liquid chamber 202 is performed. A depth of the formed ink liquid chamber 202 is in a range of 50 μm and 100 μm, and it has been difficult to form a liquid contact film with a uniform thickness on the inner side walls of the ink liquid chamber 202 as described above.

To eliminate the problem, in the present embodiment, the formation of a liquid contact film is performed by repeating the formation of the liquid chamber and the deposition of a liquid contact film 205 (see FIG. 4) in the actuator portion using an inductive coupling type Bosch process. This inductive coupling type Bosch process is the technology of deep etching of silicon. The etching of silicon is performed while the protection film is deposited on the inner side walls by repeating an etching step and a protection film deposition step.

Next, a manufacturing process of an embodiment of the present disclosure which performs the formation of a liquid chamber and the deposition of the liquid contact film of the actuator portion will be described with reference to FIGS. 5A to 5E and FIGS. 6A to 6E. FIGS. 5A to 6E are diagrams for explaining the manufacturing process of this embodiment.

Figures 5A, 5B, 5C:
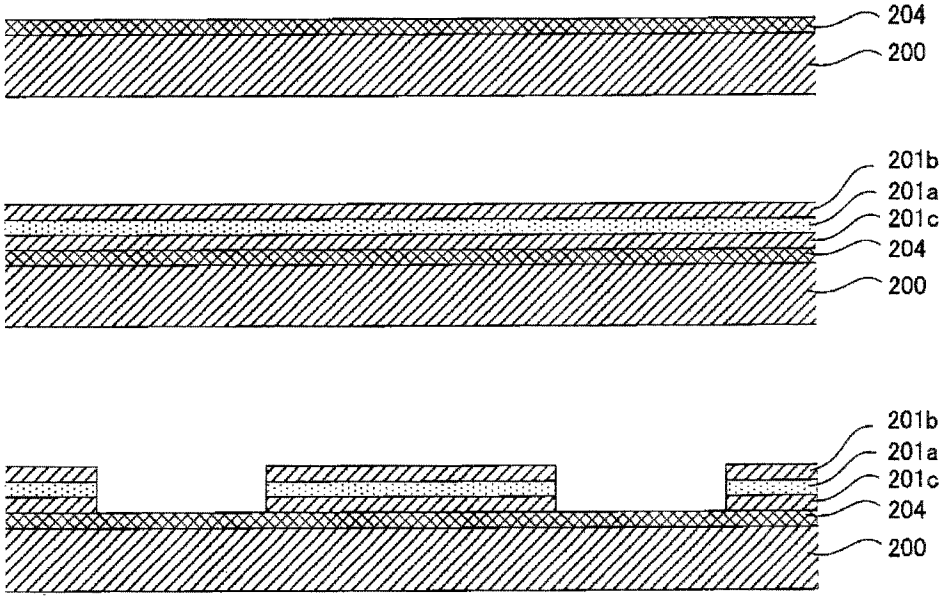
FIGS. 5A to 5E are diagrams for explaining a manufacturing process of an embodiment of the present disclosure which forms a liquid contact film on a liquid chamber side wall of a liquid drop ejecting head.

As shown in FIG. 5A, the diaphragm 204 is formed on one surface of the actuator plate 200. For example, the actuator plate 200 is formed from a silicon wafer of silicon crystals in the orientation <100>. The diaphragm 204 is formed to have a composition in which desired characteristics of displacement, strength and rigidity are obtained with thermal oxidation films, and a silicon nitride film a polysilicon film and an oxide film formed by the CVD (chemical vapor deposition) method.

As shown in FIG. 5B, the actuator element 201 is formed on the diaphragm 204. The actuator element 201 includes an upper electrode film 201*b*, a piezoelectric film 201*a* and a lower electrode film 201*c*, and this lower electrode film 201*c* is composed of a Ti layer, a Pt layer, and a SrO layer. The piezoelectric film 201*a* (which is formed into a piezoelectric device) is formed on the lower electrode film 201*c* to have a desired thickness by using the Sol-Gel method. The upper electrode film 201*b* is formed on the piezoelectric film 201*a*, and this upper electrode film 201*b* is composed of a SrO layer and a Pt layer.

Subsequently, as shown in FIG. 5C, a photolithography and etching step is performed on the laminated actuator element 201 so that the actuator element 201 has a desired liquid chamber pattern and size.

Figure 5D:
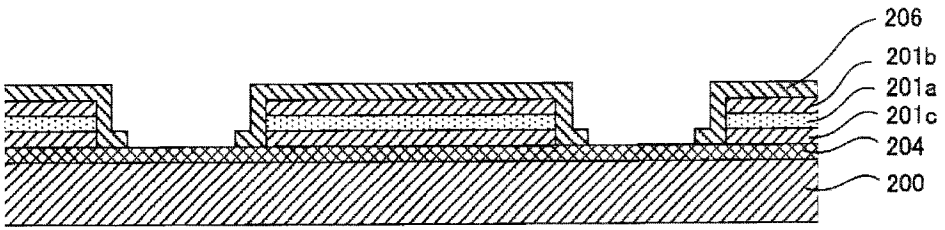

As shown in FIG. 5D, the insulating protection film 206 is formed on the actuator element 201 in which the desired liquid chamber pattern and size is formed. The thus formed insulating protection film 206 has a two-layer structure including an $Al_3O_2$ film formed by the ALD (atomic layer deposition) method and an oxide film formed by the CVD method. Thereafter, a metal wiring step for forming a metal wiring layer for transmitting electric signals to external circuits and a passivation step for protecting the metal wiring layer are performed so that the actuator portion is formed.

Figure 5E:
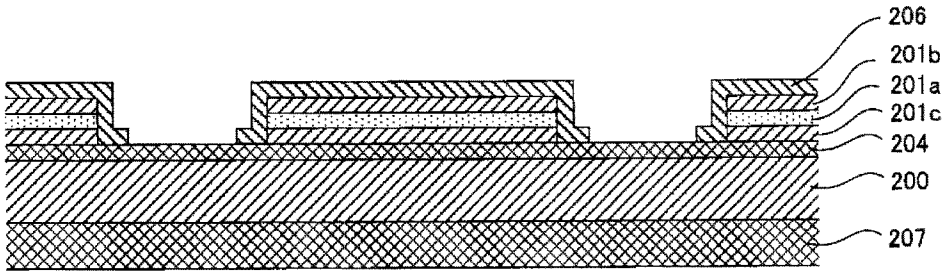

Subsequently, as shown in FIG. 5E, a resist 207 is applied to the other surface of the actuator plate 200 opposite to the actuator element 201 in order to form the ink liquid chamber 202 in the lower surface of the actuator plate 200.

Figure 6A:
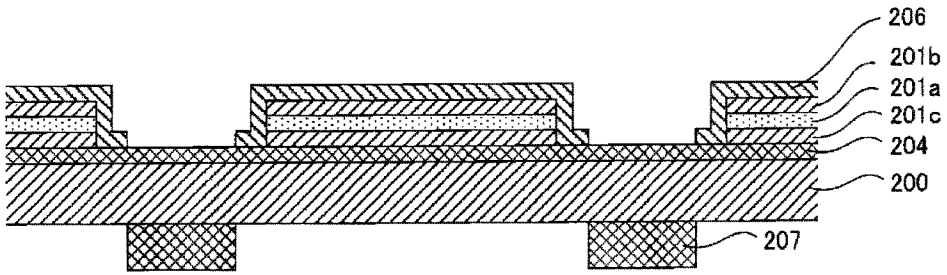
FIGS. 6A to 6E are diagrams for explaining the manufacturing process of the present embodiment which forms the liquid contact film on the liquid chamber side wall of the liquid drop ejecting head.

Next, as shown in FIG. 6A, the wafer, in which chips (not illustrated) including the resist 207 applied to the actuator plate 200 for forming the ink liquid chamber 202 in the actuator plate 200 are arrayed, is placed in an enclosed space of a vacuum state (or a vacuum chamber).

Figure 6B:
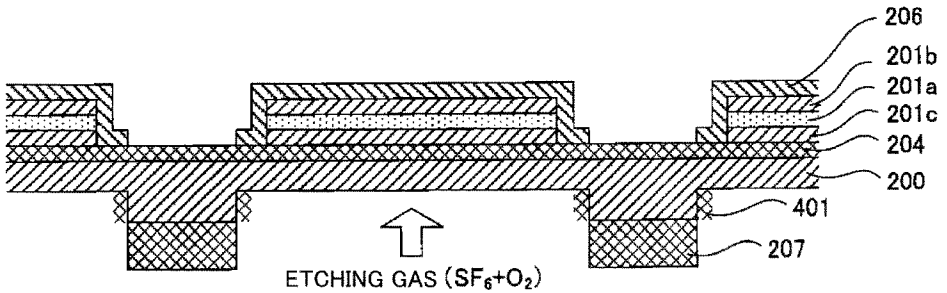

As shown in FIG. 6B, an etching step is performed. An etching gas containing sulfur hexafluoride ($SF_6$) and oxygen ($O_2$) is supplied into the enclosed space. Etching of the actuator plate 200 is performed with the supplied etching gas and a $SiF_xO_y$ film (where x and y denote unspecified numbers) 401 of silicon fluoride oxide is formed on the etched side walls of the actuator plate 200 as a by-product of a chemical reaction of the components of the etching gas and the components of the silicon wafer.

Figures 6C, 6D:
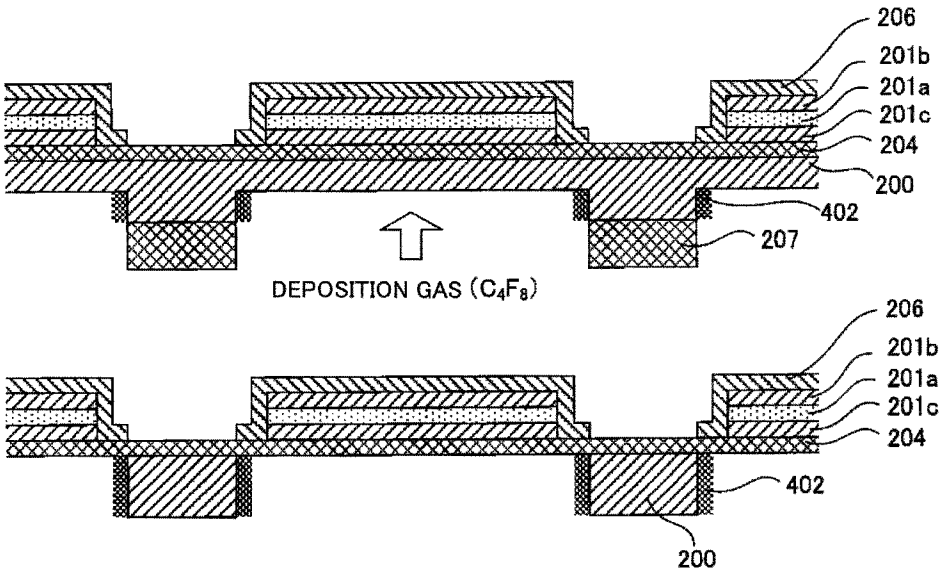

When the etching is performed to some extent, a liquid contact film deposition step is performed. As shown in FIG. 6C, a deposition gas (protection film forming gas), such as $C_4F_8$, is supplied into the enclosed space. At this time, the deposition gas (e.g., $C_4F_8$(contacts the previously formed $SiF_xO_y$ film, and a chemical reaction of the two components is performed, so that a liquid contact film 402 which is a CFx film (where x denotes an unspecified number) of fluorocarbon is formed.

The liquid contact film deposition step of FIG. 6C and the etching step of FIG. 6B are repeated alternately. In other words, the liquid contact film 402 is formed while the etching is performed. The amount of the etching in the inner wall direction can be controlled and deep etching can be carried out. Therefore, the microstructure of the ink liquid chamber 202 can be formed with good accuracy.

Subsequently, after the resist 207 is removed, as shown in FIG. 6D, the liquid contact film 402 (which is a protection film) is formed all over the inner side walls to have a predetermined etching quantity. The amount of the etching gas supplied in the etching step and the amount of the deposition gas supplied in the liquid contact film deposition step are determined appropriately by monitoring the amounts of these gases supplied in the alternately repeated steps.

Figure 6E:
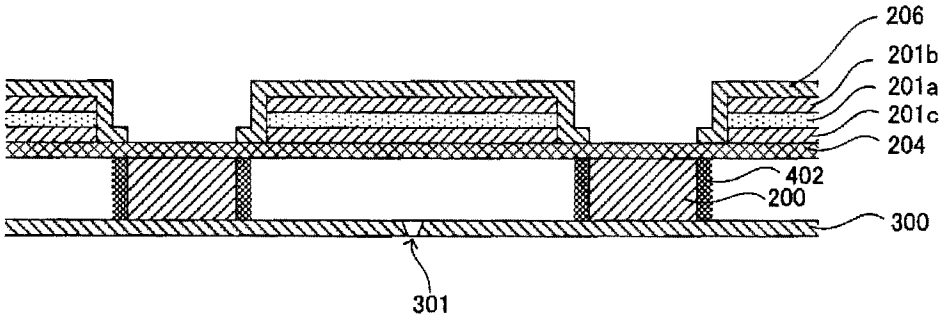

Subsequently, as shown in FIG. 6E, the nozzle plate 300 is bonded to the actuator plate 200 by the adhesive.

Accordingly, it is possible to form the liquid contact film having a uniform thickness on the inner side walls of the liquid chambers.

Next, a modification of the present embodiment will be described with reference to FIG. 7. In this modification, a metal oxide layer is formed on the liquid contact film. Conventionally, according to the related art, a metal oxide layer is used as a protection film on the inner side walls of the liquid chamber.

Figure 7:
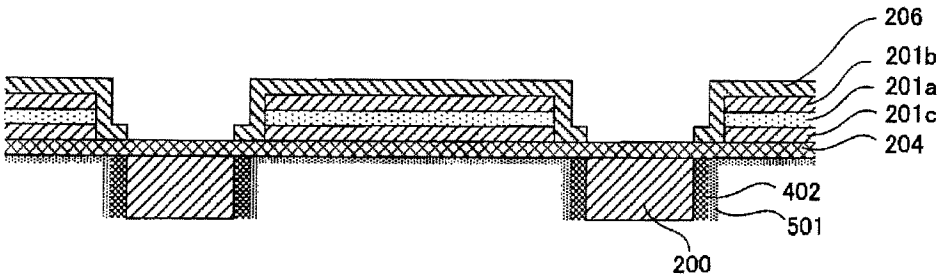
FIG. 7 is a diagram for explaining a modification of the manufacturing process which deposits a transition metal oxide film on the liquid contact film of the liquid chamber side wall of the liquid drop ejecting head.

As shown in FIG. 7, a transition metal oxide film 501 of tantalum oxide ($Ta_2O_5$) or zirconium oxide ($ZrO_2$) is formed on the liquid contact film 402. For example, this metal oxide film 501 is formed by a vacuum deposition method, such as a sputtering technique. In this composition, even if the thickness of the metal oxide film 501 on the inner side walls of the liquid chamber is relatively small, the two-layer structure of the liquid contact film 402 and the metal oxide film 501 deposited on the Liquid contact film 402 improves the liquid resistance of the liquid drop ejecting head and provides good reliability over an extended period of time.

All examples and conditional language provided herein are intended for the purposes of aiding the reader in understanding the invention and the concepts contributed by the inventors to further the art and are not to be construed as limitations to such specifically recited examples and conditions, nor does the organization of such examples in the specification relate to a showing of the superiority and inferiority of the invention.

Example 1

In a liquid drop ejecting head of this example, liquid chambers are formed in a liquid chamber substrate which is a silicon substrate, and a protection film is formed on an inner side wall of each liquid chamber by a chemical reaction of fluorocarbon and silicon fluoride oxide of a by-product formed on the inner side wall of each liquid chamber with the formation of the liquid chambers in the liquid chamber substrate. According to this example, as in the above-described embodiment, with the etching gas supplied into the enclosed space where the actuator plate 200 is arranged, dry etching of the actuator plate 200 is performed, and a part of each liquid chamber is formed. On the inner side wall of each liquid chamber being formed by the dry etching, a film 401 of silicon fluoride oxide of a by-product is formed by a chemical reaction of sulfur hexafluoride of the etching gas and silicon of the actuator plate 200. It has been confirmed that this film 401 is formed with a uniform thickness. In the protection film forming step, the deposition gas containing fluorocarbon is supplied into the enclosed space and fluorocarbon of the deposition gas contacts the film 401 formed by the dry etching so that a chemical reaction of fluorocarbon and silicon fluoride oxide is performed on the film 401, and a liquid contact film 402 which results in the protection film is formed with a uniform thickness. Because the protection film is formed on the inner side wall, the amount of the etching in the inner wall direction is controlled and deep etching can be performed. Hence, the microstructure of the liquid chambers can be formed with good accuracy. Unlike the conventional thermal oxidation method, any heating process is not used and the liquid chamber substrate is not deformed by the heating. Hence, the protection film having a uniform thickness can be formed on the inner side walls of the liquid chambers without affecting the liquid chamber substrate. Accordingly, it is possible to provide a liquid drop ejecting head with good liquid resistance.

Example 2

In the liquid drop ejecting head of Example 1, a transition metal oxide film is formed on the protection film. According to this example, as in the above-described modification, with the two-layer laminated structure of the metal oxide film 501 and the liquid contact film 402, the liquid resistance is improved and good reliability over an extended period of time is provided.

Example 3

In an image forming device of this example, the liquid drop ejecting head of Example 1 is mounted on an image formation unit, and the image formation unit forms an image on a medium by ejecting liquid drops to the medium from the liquid drop ejecting head. According to this example, as in the above-described embodiment, the image forming device has good liquid resistance to the printing liquid and can perform stable image formation.

Example 4

A method of manufacturing a liquid drop ejecting device of this example includes an etching step of etching a liquid chamber substrate to have a predetermined liquid chamber pattern with an etching gas, and a protection film deposition step of forming a protection film on an inner side wall of each of liquid chambers. The etching step includes: placing a silicon substrate to form the liquid chamber substrate in an enclosed space; supplying the etching gas containing sulfur hexafluoride and oxygen into the enclosed space; forming the liquid chambers in the liquid chamber substrate; and forming a by-product of silicon fluoride oxide on the inner side wall of each liquid chamber by a chemical reaction of sulfur hexafluoride and oxygen of the etching gas and silicon of the liquid chamber substrate. The protection film deposition step includes: supplying a protection film forming gas of fluorocarbon into the enclosed space; and performing a chemical reaction of silicon fluoride oxide of the by-product formed on the inner side wall by the etching step and fluorocarbon of the protection film forming gas to form the protection film on the inner side wall.

According to this example, as in the above-described embodiment, deep etching is possible and the protection films having a uniform thickness can be formed on the inner side walls of the liquid chambers without affecting the liquid chamber substrate. It is no longer necessary to use expensive film deposition equipment as in the conventional sputtering techniques or deposition methods. Therefore, it is possible to provide the manufacturing method of the liquid drop ejecting head having good liquid resistance.

Example 5

In the manufacturing method of Example 4, the etching step and the protection film deposition step are repeated alternately. According to this example, as in the above-described embodiment, deep etching can be performed with a predetermined depth and the protection film having a uniform thickness can be formed on the inner side walls of the liquid chambers.

Example 6

In the manufacturing method of Example 4, a metal oxide film deposition step of forming a transition metal oxide film on the protection film is included. According to this example, as in the above-described modification, with the two-layer laminated structure of the metal oxide film 501 and the liquid contact film 402, the liquid resistance is improved and good reliability over an extended period of time is provided.

As described in the foregoing, according to the present disclosure, the by-product of silicon fluoride oxide is formed on the inner side wall of each liquid chamber with the formation of the liquid chamber in the liquid chamber substrate (which is a silicon substrate). It has been confirmed that the film of silicon fluoride oxide is formed with a uniform thickness. The protection film is formed on the inner side wall by a chemical reaction of fluorocarbon and silicon fluoride oxide and the protection film also has a uniform thickness. Unlike the conventional thermal oxidation method, any heating process is not used and the liquid chamber substrate is not deformed by the heating. Hence, the protection films having a uniform thickness can be formed on the inner side walls of the liquid chambers without affecting the liquid chamber substrate. Accordingly, it is possible to provide the liquid drop ejecting head having good liquid resistance.

The liquid drop ejecting head of the present disclosure is not limited to the specifically disclosed embodiments, and it should be understood that the various changes, substitutions and alterations could be made hereto without departing from the spirit and scope of the invention.

The present application is based upon and claims the benefit of priority of Japanese Patent Application No. 2012-064862, filed on Mar. 22, 2012, the contents of which are incorporated herein by reference in their entirety.

What is claimed is:

1. A liquid drop ejecting head comprising:

a nozzle plate that forms nozzles;

a liquid chamber substrate that includes a first surface bonded to the nozzle plate and forms liquid chambers provided for the nozzles and communicating with the nozzles respectively;

a diaphragm that is bonded to a second surface of the liquid chamber substrate opposite to the first surface to form apart of each of the liquid chambers;

a pressure generating unit that gives pressure oscillation to the diaphragm in accordance with a liquid drop eject signal from a host device to exert pressure on a liquid in each of the liquid chambers through the diaphragm; and a fluorocarbon protection film provided as a wall that constitutes an inner side wall of each of the liquid chambers, wherein the fluorocarbon protection film is formed on a wall of the liquid chamber substrate which is a silicon substrate, wherein for each liquid chamber amongst the liquid chambers of the liquid drop ejecting head, a transition metal oxide film is formed on the fluorocarbon protection film constituting the inner side wall of the liquid chamber.

2. An image forming device comprising: the liquid drop ejecting head according to claim 1; and an image formation unit including the liquid drop ejecting head mounted therein to form an image on a medium by ejecting liquid drops to the medium from the liquid drop ejecting head.

* * * * *